US005846010A

United States Patent [19]

Barbalich

[11] Patent Number: 5,846,010

[45] Date of Patent: Dec. 8, 1998

[54] TOOTHPASTE DISPENSING TOOTHBRUSH

[76] Inventor: Daniel B. Barbalich, 77-13 Ditmars Blvd., Jackson Heights, New York City, N.Y. 11370

[21] Appl. No.: 960,976

[22] Filed: Oct. 30, 1997

[51] Int. Cl.[6] ..... A46B 11/02

[52] U.S. Cl. ..... 401/186; 401/183; 401/184; 401/8

[58] Field of Search ..... 401/183, 184, 401/186, 8

[56] References Cited

U.S. PATENT DOCUMENTS

| | | | |
|---|---|---|---|
| 1,504,143 | 8/1924 | Roberts | 401/183 X |
| 1,676,601 | 7/1928 | Cavanaugh | 401/183 X |
| 2,582,404 | 1/1952 | Zavada | 401/186 |
| 2,845,645 | 8/1958 | Wishnefsky et al. | 401/183 X |
| 5,028,158 | 7/1991 | Fey | 401/183 |

FOREIGN PATENT DOCUMENTS

| | | | |
|---|---|---|---|
| 2354236 | 5/1975 | Germany | 401/184 |

*Primary Examiner*—Steven A. Bratlie

[57] ABSTRACT

An automatic toothpaste dispensing toothbrush is provided including a toothpaste containment portion. Such toothpaste containment portion is constructed from a resilient collapsible elastomeric material and has a compartment for housing a tube of toothpaste. A toothbrush portion has an outboard extent with a plurality of bristles mounted thereon and extending downwardly therefrom. The toothbrush portion further has an inboard extent and a toothpaste conduit. Associated with the conduit is a first opening formed a bottom face of the outboard extent and a second opening formed in a rear face of the inboard extent. An interior surface of the second opening has a plurality of threaded grooves formed therein for releasably coupling with a toothpaste tube. As such, the tube of toothpaste may be screwably coupled to the toothbrush portion and further situated within the compartment of the toothpaste containment portion and the toothpaste containment portion and toothbrush portion coupled. A valve assembly includes a vertical linear bore formed in the top face of the inboard extent of the toothbrush portion. A post with an aperture formed therein is slidably situated within the bore of the valve assembly. A spring situated within the bore below the post. During use, the valve assembly has a raised unbiased orientation with the aperture of the post misaligned with the conduit to preclude the flow of toothpaste therethrough and a lowered biased orientation with the aperture of the post aligned with the conduit to allow the flow of toothpaste therethrough upon the squeezing the toothpaste containment portion.

3 Claims, 2 Drawing Sheets

FIG 1
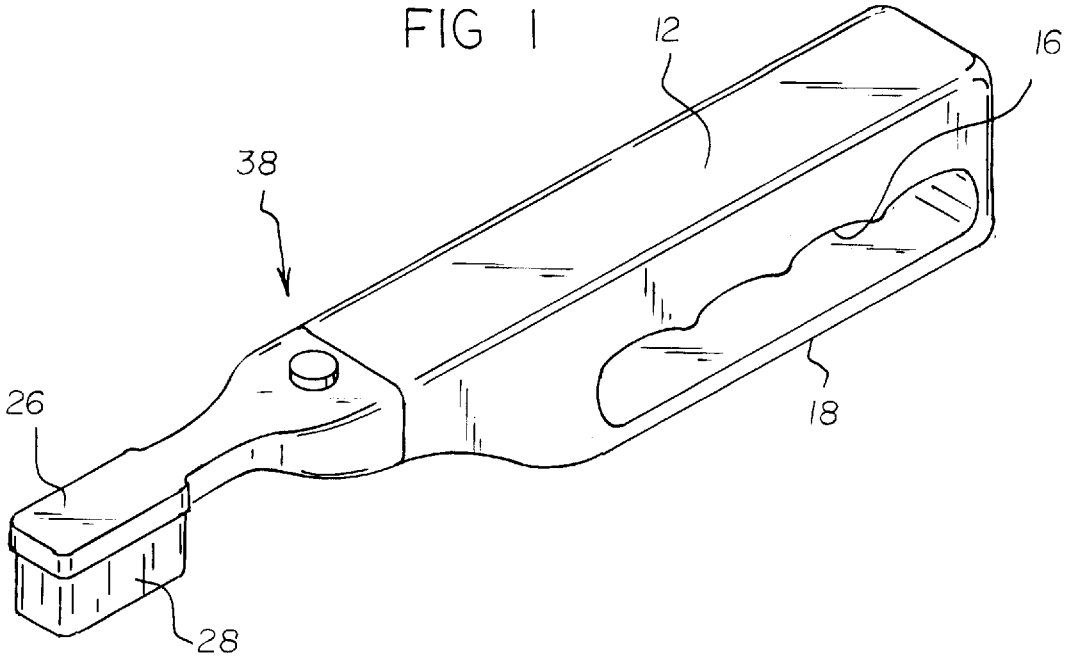
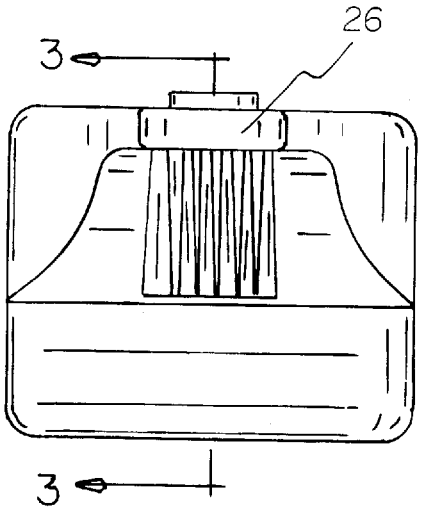
FIG 2

FIG 3
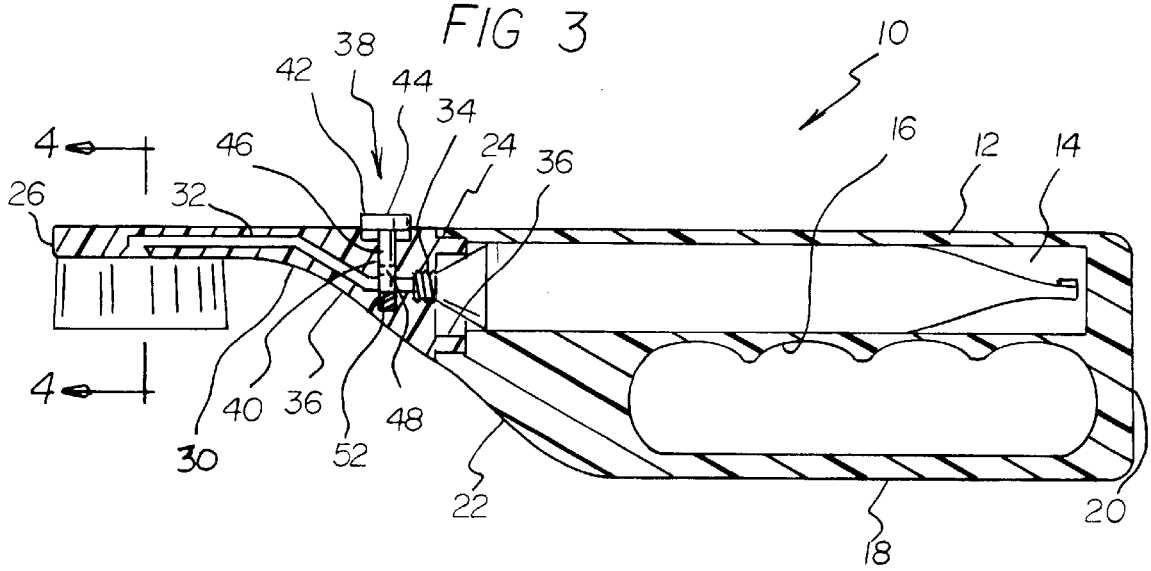
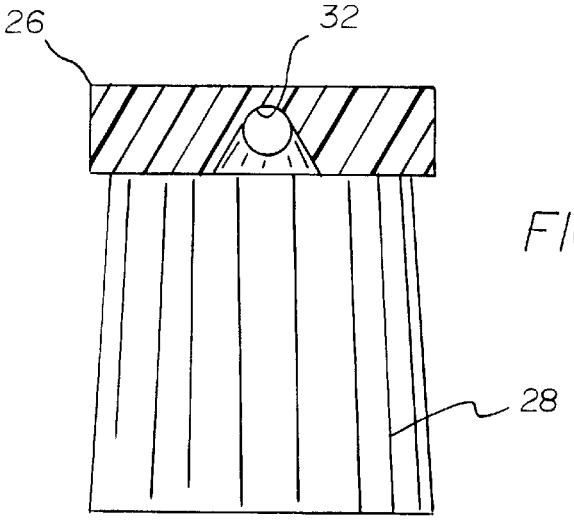
FIG 4

TOOTHPASTE DISPENSING TOOTHBRUSH

BACKGROUND OF THE INVENTION

1. Field of the Invention

The present invention relates to toothpaste dispensers and more particularly pertains to a toothpaste dispensing toothbrush for allowing elderly or handicap users brush their teeth in a convenient manner.

2. Description of the Prior Art

The use of toothpaste dispensers is known in the prior art. More specifically, toothpaste dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothpaste dispensers include U.S. Pat. No. 5,028,158; U.S. Pat. Des. 276,097; U.S. Pat. No. 4,527,574; U.S. Pat. No. 4,615,635; U.S. Pat. No. 5,123,765; and U.S. Pat. No. 5,244,298.

In these respects, the toothpaste dispensing toothbrush according to the present invention substantially departs from the conventional concepts and designs of the prior art, and in so doing provides an apparatus primarily developed for the purpose of allowing elderly or handicap users brush their teeth in a convenient manner.

SUMMARY OF THE INVENTION

In view of the foregoing disadvantages inherent in the known types of toothpaste dispensers now present in the prior art, the present invention provides a toothpaste dispensing toothbrush construction wherein the same can be utilized for allowing elderly or handicap users brush their teeth in a convenient manner.

The general purpose of the present invention, which will be described subsequently in greater detail, is to provide a toothpaste dispensing toothbrush apparatus and method which has many of the advantages of the toothpaste dispensers mentioned heretofore and many novel features that result in a toothpaste dispensing toothbrush which is not anticipated, rendered obvious, suggested, or even implied by any of the prior art toothpaste dispensers, either alone or in any combination thereof.

To attain this, the present invention generally comprises a toothpaste containment portion with a generally rectangular configuration. As shown in the various Figures, the toothpaste containment portion is equipped with a rectangular planar top face, a square rear face, a bottom face, an open front face and a pair of planar side faces. The containment portion has an elongated rectangular compartment formed therein which resides in communication with the open front face. The containment portion is preferably constructed from a resilient collapsible elastomeric material. The bottom face has a plurality of undulations formed therein. A handle with a planar rectangular configuration is mounted in spaced relationship with the bottom face. Such is accomplished by way of a rear stanchion residing in coplanar relationship with the rear face and a tapering front stanchion. For reasons that will become apparent hereinafter, the front face has a rectangular inset portion formed about a periphery of the open front face. Next provided is a toothbrush portion having an outboard extent with a planar rectangular configuration. The outboard portion is defined by a top face, a bottom face, and a periphery formed therebetween. The bottom face of the outboard extent has a plurality of bristles mounted thereon and extending downwardly therefrom. The toothbrush portion further has an inboard extent with a top planar face in coplanar relationship with the top face of the outboard extent. The inboard portion is further equipped with a tapering bottom face. The toothbrush portion has a toothpaste conduit having a first opening formed in a central extent of the bottom face of the outboard extent. A second opening is formed in a rear face of the inboard extent. An interior surface of the second opening has a plurality of threaded grooves formed therein for releasably coupling with a toothpaste tube. The rear face of the inboard extent further includes a rectangular coupling sleeve integrally coupled about the second opening of the conduit and extending rearwardly therefrom. By this structure, the tube of toothpaste may be screwably coupled to the toothbrush portion. Thereafter, the tube is further situated within the compartment of the toothpaste containment portion. Then, the sleeve is frictionally coupled with the rectangular inset portion of the toothpaste containment portion. This maintains the top face of the toothpaste containment portion in coplanar relationship with that of the toothbrush portion. Further, the bottom face of the inboard extent of the toothbrush portion forms a smooth taper with the tapering front stanchion of the toothpaste containment portion. Finally, a valve assembly is provided including a vertical linear bore formed in the top face of the inboard extent of the toothbrush portion. Such bore extends through and past the conduit adjacent to the second opening. A push button has an upper disk with a post integrally coupled to a bottom face thereof and extending downwardly therefrom. An aperture is formed in the post. During use, the post is slidably situated within the bore of the valve assembly. A spring is situated within the bore below the post. As such, the valve assembly has a raised unbiased orientation with the aperture of the post misaligned with the conduit. This precludes the flow of toothpaste therethrough. The valve assembly further has a lowered biased orientation with the aperture of the post aligned with the conduit to allow the flow of toothpaste therethrough upon the squeezing the toothpaste containment portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a toothpaste dispensing toothbrush apparatus and method which has many of the advantages of the toothpaste dispensers mentioned heretofore and many novel features that result in a toothpaste dispensing toothbrush which is not anticipated, rendered obvious, suggested, or even implied by any of the prior art toothpaste dispensers, either alone or in any combination thereof.

It is another object of the present invention to provide a toothpaste dispensing toothbrush which may be easily and efficiently manufactured and marketed.

It is a further object of the present invention to provide a toothpaste dispensing toothbrush which is of a durable and reliable construction.

An even further object of the present invention is to provide a toothpaste dispensing toothbrush which is susceptible of a low cost of manufacture with regard to both materials and labor, and which accordingly is then susceptible of low prices of sale to the consuming public, thereby making such toothpaste dispensing toothbrush economically available to the buying public.

Still yet another object of the present invention is to provide a toothpaste dispensing toothbrush which provides in the apparatuses and methods of the prior art some of the advantages thereof, while simultaneously overcoming some of the disadvantages normally associated therewith.

Still another object of the present invention is to provide a toothpaste dispensing toothbrush for allowing elderly or handicap users brush their teeth in a convenient manner.

Even still another object of the present invention is to provide a toothpaste dispensing toothbrush that includes a toothpaste containment portion. Such toothpaste containment portion is constructed from a resilient collapsible elastomeric material and has a compartment for housing a tube of toothpaste. A toothbrush portion has an outboard extent with a plurality of bristles mounted thereon and extending downwardly therefrom. The toothbrush portion further has an inboard extent and a toothpaste conduit. Associated with the conduit is a first opening formed a bottom face of the outboard extent and a second opening formed in a rear face of the inboard extent. An interior surface of the second opening has a plurality of threaded grooves formed therein for releasably coupling with a toothpaste tube. As such, the tube of toothpaste may be screwably coupled to the toothbrush portion and further situated within the compartment of the toothpaste containment portion and the toothpaste containment portion and toothbrush portion coupled. A valve assembly includes a vertical linear bore formed in the top face of the inboard extent of the toothbrush portion. A post with an aperture formed therein is slidably situated within the bore of the valve assembly. A spring situated within the bore below the post. During use, the valve assembly has a raised unbiased orientation with the aperture of the post misaligned with the conduit to preclude the flow of toothpaste therethrough and a lowered biased orientation with the aperture of the post aligned with the conduit to allow the flow of toothpaste therethrough upon the squeezing the toothpaste containment portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a toothpaste dispensing toothbrush according to the present invention.

FIG. 2 is a front view of the present invention.

FIG. 3 is a side cross-sectional view of the present invention taken along line 3—3 shown in FIG. 2.

FIG. 4 is a front view of the present invention.

DESCRIPTION OF THE PREFERRED EMBODIMENT

With reference now to the drawings, and in particular to FIGS. 1 through 4 thereof, a toothpaste dispensing toothbrush embodying the principles and concepts of the present invention and generally designated by the reference numeral 10 will be described.

The present invention, as designated as numeral 10, includes a toothpaste containment portion 12 with a generally rectangular configuration. As shown in the various Figures, the toothpaste containment portion is equipped with a rectangular planar top face, a square rear face, a bottom face, an open front face and a pair of planar side faces. The containment portion has an elongated rectangular compartment 14 formed therein which resides in communication with the open front face. The containment portion is preferably constructed from a resilient collapsible elastomeric material. The bottom face has a plurality of undulations 16 formed therein. Each undulation is defines a portion of a cylinder.

A handle 18 with a planar rectangular configuration is mounted in spaced relationship with the bottom face. Such is accomplished by way of a rear stanchion 20 residing in coplanar relationship with the rear face and a tapering front stanchion 22. Preferably, the handle has a width equal to that of the toothpaste containment portion. For reasons that will become apparent hereinafter, the front face has a rectangular inset portion 24 formed about a periphery of the open front face.

Next provided is a toothbrush portion 26 having an outboard extent with a planar rectangular configuration. The outboard portion is defined by a top face, a bottom face, and a periphery formed therebetween. The bottom face of the outboard extent has a plurality of bristles 28 mounted thereon and extending downwardly therefrom. The toothbrush portion further has an inboard extent with a top planar face in coplanar relationship with the top face of the outboard extent. As shown in FIG. 1, the outboard extent has a reduced width as compared to the inboard extent. The inboard portion is further equipped with a tapering bottom face 30.

The toothbrush portion has a toothpaste conduit 32 having a first opening formed in a central extent of the bottom face of the outboard extent. The first opening preferably has a frusto-conical shape for facilitating the dispensing of toothpaste therefrom, as will soon become apparent. A second opening is formed in a rear face of the inboard extent. An interior surface of the second opening has a plurality of threaded grooves 34 formed therein for releasably coupling with a toothpaste tube. As a whole, the conduit is defined by a first horizontal portion, a second horizontal portion and a slanted intermediate portion. The rear face of the inboard extent further includes a rectangular coupling sleeve 36 integrally coupled about the second opening of the conduit and extending rearwardly therefrom.

By this structure, the tube of toothpaste may be screwably coupled to the toothbrush portion. Thereafter, the tube is further situated within the compartment of the toothpaste containment portion. Then, the sleeve is frictionally coupled with the rectangular inset portion of the toothpaste containment portion. This maintains the top face of the toothpaste containment portion in coplanar relationship with that of the toothbrush portion. Further, the bottom face of the inboard extent of the toothbrush portion forms a smooth taper with the tapering front stanchion of the toothpaste containment portion.

Finally, a valve assembly 38 is provided including a vertical linear bore 40 formed in the top face of the inboard extent of the toothbrush portion. Such bore extends through and past the conduit adjacent to the second opening. A push button 42 has an upper disk 44 with a post 46 integrally coupled to a bottom face thereof and extending downwardly therefrom. An aperture 48 is formed in the post. During use, the post is slidably situated within the bore of the valve assembly. A spring 52 is situated within the bore below the post.

As such, the valve assembly has a raised unbiased orientation with the aperture of the post misaligned with the conduit. This precludes the flow of toothpaste therethrough. In the raised unbiased orientation, an unillustrated annular flange prevents the spring from forcing the entire button out of the bore. The valve assembly further has a lowered biased orientation with the aperture of the post aligned with the conduit to allow the flow of toothpaste therethrough upon the squeezing the toothpaste containment portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste dispensing toothbrush comprising, in combination:

a toothpaste containment portion with a generally rectangular configuration with a rectangular planar top face, a square rear face, a bottom face, an open front face and a pair of planar side faces, the containment portion having an elongated rectangular compartment formed therein which resides in communication with the open front face, the containment portion being constructed from a resilient collapsible elastomeric material, the bottom face having a plurality of undulations formed therein which each define a portion of a cylinder and a handle with a planar rectangular configuration mounted in spaced relationship therewith via a rear stanchion residing in coplanar relationship with the rear face and a tapering front stanchion, the front face having a rectangular inset portion formed about a periphery of the open front face, wherein the handle has a width equal to that of the toothpaste containment portion;

a toothbrush portion having an outboard extent with a planar rectangular configuration defined by a top face, a bottom face, and a periphery formed therebetween, the bottom face of the outboard extent having a plurality of bristles mounted thereon and extending downwardly therefrom, the toothbrush portion further having an inboard extent with a top planar face in coplanar relationship with the top face of the outboard extent and a tapering bottom face, wherein the outboard extent has a reduced thickness as compared to the inboard extent, the toothbrush having a toothpaste conduit having a first opening with a frusto-conical configuration formed in a central extent of the bottom face of the outboard extent and a second opening formed in a rear face of the inboard extent with an interior surface of the second opening having a plurality of threaded grooves formed therein for releasably coupling with a toothpaste tube, the conduit being defined by a first horizontal portion, a second horizontal portion and a slanted intermediate portion, the rear face of the inboard extent further including a rectangular coupling sleeve integrally coupled about the second opening of the conduit and extending rearwardly therefrom, whereby the tube of toothpaste may be screwably coupled to the toothbrush portion and further situated within the compartment of the toothpaste containment portion such that the sleeve frictionally couples with the rectangular inset portion of the toothpaste containment portion thereby maintaining the top face of the toothpaste containment portion in coplanar relationship with that of the toothbrush portion and further the bottom face of the inboard extent of the toothbrush portion forms a smooth taper with the tapering front stanchion of the toothpaste containment portion; and a valve assembly including a vertical linear bore formed in the top face of the inboard extent of the toothbrush portion and extended through and past the conduit adjacent to the second opening, a push button having an upper disk with a post integrally coupled to a bottom face thereof and extending downwardly therefrom with an aperture formed in the post wherein the post is slidably situated within the bore of the valve assembly, and a spring situated within the bore below the post, whereby the valve assembly has a raised unbiased orientation with the aperture of the post misaligned with the conduit to preclude the flow of toothpaste therethrough and a lowered biased orientation with the aperture of the post aligned with the conduit to allow the flow of toothpaste therethrough upon the squeezing the toothpaste containment portion.

2. A toothpaste dispensing toothbrush comprising:

a toothpaste containment portion constructed from a resilient collapsible elastomeric material and having a compartment for housing a tube of toothpaste, wherein a handle with a planar rectangular configuration is mounted in spaced relationship with the toothpaste containment portion via a rear stanchion residing in coplanar relationship with a rear face of the toothpaste containment portion and a tapering front stanchion, the front face having a rectangular inset portion formed about a periphery of an open front face thereof;

a toothbrush portion having an outboard extent having a plurality of bristles mounted thereon and extending downwardly therefrom, the toothbrush portion further having an inboard extent and a toothpaste conduit including a first opening formed on a bottom face of the outboard extent and a second opening formed in a rear face of the inboard extent with an interior surface of the second opening having a plurality of threaded grooves formed therein for releasably coupling with a toothpaste tube, the conduit defined by a first horizontal portion, a second horizontal portion and a slanted intermediate portion, whereby the tube of toothpaste may be screwably coupled to the toothbrush portion and further situated within the compartment of the toothpaste containment portion and the toothpaste containment portion and toothbrush portion coupled, thereby maintaining a top face of the toothpaste containment portion in coplanar relationship with that of the toothbrush portion, wherein the rear face of the inboard extent further includes a rectangular coupling sleeve integrally coupled about the second opening of the conduit and extending rearwardly therefrom; and a valve assembly including a vertical linear bore formed in the inboard extent of the toothbrush portion, a post with an aperture formed therein wherein the post is slidably situated within the bore of the inboard extent, and a spring situated within the bore below the post, whereby the valve assembly has a raised unbiased orientation with the aperture of the post misaligned with the conduit to preclude the flow of toothpaste therethrough and a lowered biased orientation with the aperture of the post aligned with the conduit to allow the flow of toothpaste therethrough upon the squeezing the toothpaste containment portion.

3. A toothpaste dispensing toothbrush as set forth in claim 2 wherein the toothpaste containment portion has a plurality of undulations formed in a bottom face thereof.

* * * * *